US007588305B2

(12) United States Patent
Knierim et al.

(10) Patent No.: US 7,588,305 B2
(45) Date of Patent: Sep. 15, 2009

(54) DUAL DROP PRINTING MODE USING FULL LENGTH WAVEFORMS TO ACHIEVE HEAD DROP MASS DIFFERENCES

(75) Inventors: David L. Knierim, Wilsonville, OR (US); Trevor J. Snyder, Newberg, OR (US); Joel Chan, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 381 days.

(21) Appl. No.: 11/139,700

(22) Filed: May 31, 2005

(65) Prior Publication Data

US 2006/0268036 A1 Nov. 30, 2006

(51) Int. Cl.
*B41J 29/38* (2006.01)

(52) U.S. Cl. ..... 347/14; 347/41

(58) Field of Classification Search ..... 347/10, 347/14, 15, 43, 41
See application file for complete search history.

(56) References Cited

U.S. PATENT DOCUMENTS

| | | | | |
|---|---|---|---|---|
| 5,389,958 | A | 2/1995 | Bui et al. | |
| 5,412,410 | A | 5/1995 | Rezanka | |
| 5,495,270 | A | 2/1996 | Burr et al. | |
| 5,734,393 | A | 3/1998 | Eriksen | |
| 5,745,131 | A | 4/1998 | Kneezel et al. | |
| 5,949,452 | A | 9/1999 | Jones | |
| 6,106,093 | A * | 8/2000 | Nagoshi et al. | 347/15 |
| 6,137,502 | A | 10/2000 | Anderson et al. | |
| 6,217,149 | B1 * | 4/2001 | Takagi et al. | 347/41 |
| 6,244,686 | B1 | 6/2001 | Jensen et al. | |
| 6,328,400 | B1 * | 12/2001 | Yonekubo et al. | 347/15 |
| 6,402,280 | B2 * | 6/2002 | Kneezel et al. | 347/15 |
| 6,682,170 | B2 * | 1/2004 | Hotomi et al. | 347/43 |
| 6,799,824 | B2 * | 10/2004 | Nunokawa | 347/15 |
| 6,948,791 | B2 * | 9/2005 | Togashi et al. | 347/14 |
| 7,201,459 | B1 * | 4/2007 | Sano et al. | 347/10 |

FOREIGN PATENT DOCUMENTS

EP 1 382 455 A2 1/2004

* cited by examiner

*Primary Examiner*—Thinh H Nguyen
(74) *Attorney, Agent, or Firm*—Oliff & Berridge, PLC

(57) ABSTRACT

A dual-drop mode for a printer uses at least two full length waveforms and switches between the waveforms according to one or more patterning methodologies to print a page length document having a dual drop size print pattern across the printed portion of the page. This achieves printing from individual jet nozzles of either a large drop or a small drop. The page size patterning methodology is performed globally on at least a sub-page basis, rather than on a pixel-by-pixel basis and may be performed based on or independent of specific image data.

18 Claims, 14 Drawing Sheets

REVOLUTION 1

WAVEFORM 1 - SMALL DROP

WAVEFORM 2 - LARGE DROP

REVOLUTION 2

WAVEFORM 1 - SMALL DROP

WAVEFORM 2 - LARGE DROP

PRINT
OUTPUT
RESULT

DUAL DROP PRINTING MODE USING FULL LENGTH WAVEFORMS TO ACHIEVE HEAD DROP MASS DIFFERENCES

BACKGROUND

Dual-drop printing is achieved using two or more full length waveforms and a predetermined jet geometry that generates two or more different drop masses from each jet.

Dual-drop mode refers to the ability of the printhead to generate two or more different drop masses. However, only one of these masses is typically used in a given image. This is accomplished with the use of separate full length waveforms that achieve different drop masses from an individual jet nozzle. For example, the Phaser 340, available from Xerox Corporation, used this to achieve a 110 ng drop and a 67 ng drop by firing one of the two waveforms depending on a mode of operation. In order to achieve the smaller drop with the same jet geometry, the smaller drop waveform was run at a lower frequency.

Drop-size-switching (DSS) refers to the ability of a jet to generate a multitude of drop masses (two, for example) on-the-fly. This can be accomplished by fitting two half (½) length waveforms into the jetting time 1/fop. Here "fop" refers to "frequency of operation", which is the frequency at which drops eject from each jet of a print head when firing continuously. The electronics select one of the two waveforms according to one or more patterning methodologies to print a page length document. This achieves printing from individual jet nozzles of either a large drop or a small drop.

As shown in FIG. 1, a printhead driver 200 incorporates two separate waveforms (waveform 1 and waveform 2) into a single print firing period (1/fop). One of the two waveforms is selected "on the fly" by driver 200 to drive individual jets of printhead 100 based on specific image criteria or image quality. Printhead 100 includes an aperture plate 110 and a diaphragm plate 120. A piezoelectric transducer 130 is provided on the diaphragm plate 120. Between the two plates 110, 120 are defined ports 140, feed lines 150, manifold 160, inlet 170, body 180, outlet 185, and apertures 190. An example of this type of "on the fly" printhead is further described in U.S. Pat. No. 5,495,270 to Burr et al., the disclosure of which is hereby incorporated herein in its entirety.

This concept was introduced in the Phaser 850 Enhanced Mode, also available from Xerox Corporation. Both a 51 ng and a 24 ng drop size could be generated "on the fly." However, in this design, the printhead ran at the slower frequency of the small drop. Because the smaller drop ran at a lower frequency, it could not be printed at high speed. However, because the large drop was available to allow an overall reduction in resolution while maintaining appropriate total solid coverage, the dual-drop mode worked and was beneficial.

SUMMARY

There is always a quality/speed consideration that must be made when setting the dropmass of a printer. Large drops are needed in solid fill regions to increase color saturation at lower resolutions that afford higher print speeds, and small drops are needed in light fill regions to reduce graininess. Printing with multiple drop sizes on each image improves the image quality for a given speed and/or increases the speed for a given image quality because large drops fill solid color regions quickly while small drops reduce graininess in lighter shaded regions.

The primary limitation of the Phaser 850 method of dual-drop printing is the need to fit both a small drop waveform and a large drop waveform in a single firing period (1/fop). As newer jet designs operate at higher frequencies (increased fop), the associated period (1/fop) becomes too short to fit two waveforms. Accordingly, there is a need for an improved printing architecture and method that can address this limitation.

In accordance with various aspects, a printer architecture uses a modified DSS mode "Soft DSS" that allows smaller drops in light fill areas to decrease graininess in the image, while also allowing larger drops in solid fill areas to increase color saturation at lower resolutions to improve print quality at either extreme.

In accordance with various other aspects, a printer architecture uses a Soft DSS mode having full length waveforms, which are easier to develop and implement than half length waveforms. That is, they are much simpler to design and implement robustly within required product time cycles. An additional benefit of these "Soft DSS" modes is to maximize print speed because there will not be the wait time between pulses inherent in an "on the fly" dual-drop mode system using partial length waveforms that require slower print frequencies.

In accordance with exemplary embodiments, a Soft DSS mode printer architecture provides a page output with an alternating pattern of small and large drop sizes. In one exemplary arrangement, the pattern achieves alternating columns of large and small drops. In another exemplary embodiment, the pattern achieves alternating rows of large and small drops. In various exemplary embodiments, the pattern layout is for an entire page. In further exemplary embodiments, the pattern can change down the page, such as by printing in a checkerboard pattern, or changed in consecutive passes.

BRIEF DESCRIPTION OF THE DRAWINGS

Exemplary embodiments will be described with reference to the drawings, wherein.

DETAILED DESCRIPTION OF EMBODIMENTS

In accordance with exemplary embodiments, a printer architecture with a Soft DSS mode provides a page output with an alternating pattern of small and large drop sizes. This is suitable for use in many fluid ejection devices, such as ink jet printers. However, it is particularly beneficial when used with a phase-change, offset solid ink printer.

Figure 1:
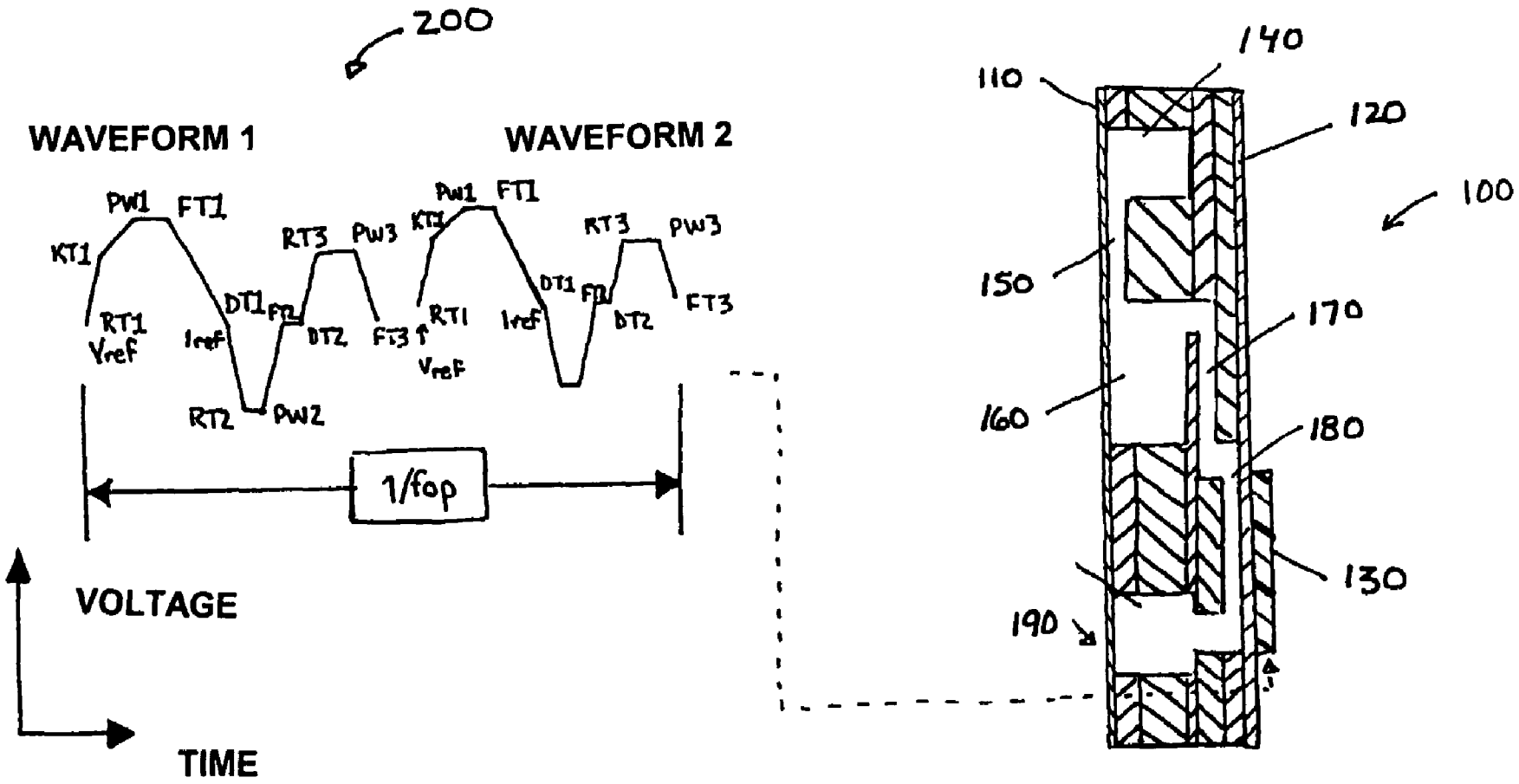
FIG. 1 RELATED ART
FIG. 1 illustrates a cross-sectional view of a conventional single geometry ink nozzle driven by one of two known dual-drop half-frequency waveforms to achieve either a large or small drop mass size.
Figure 2:
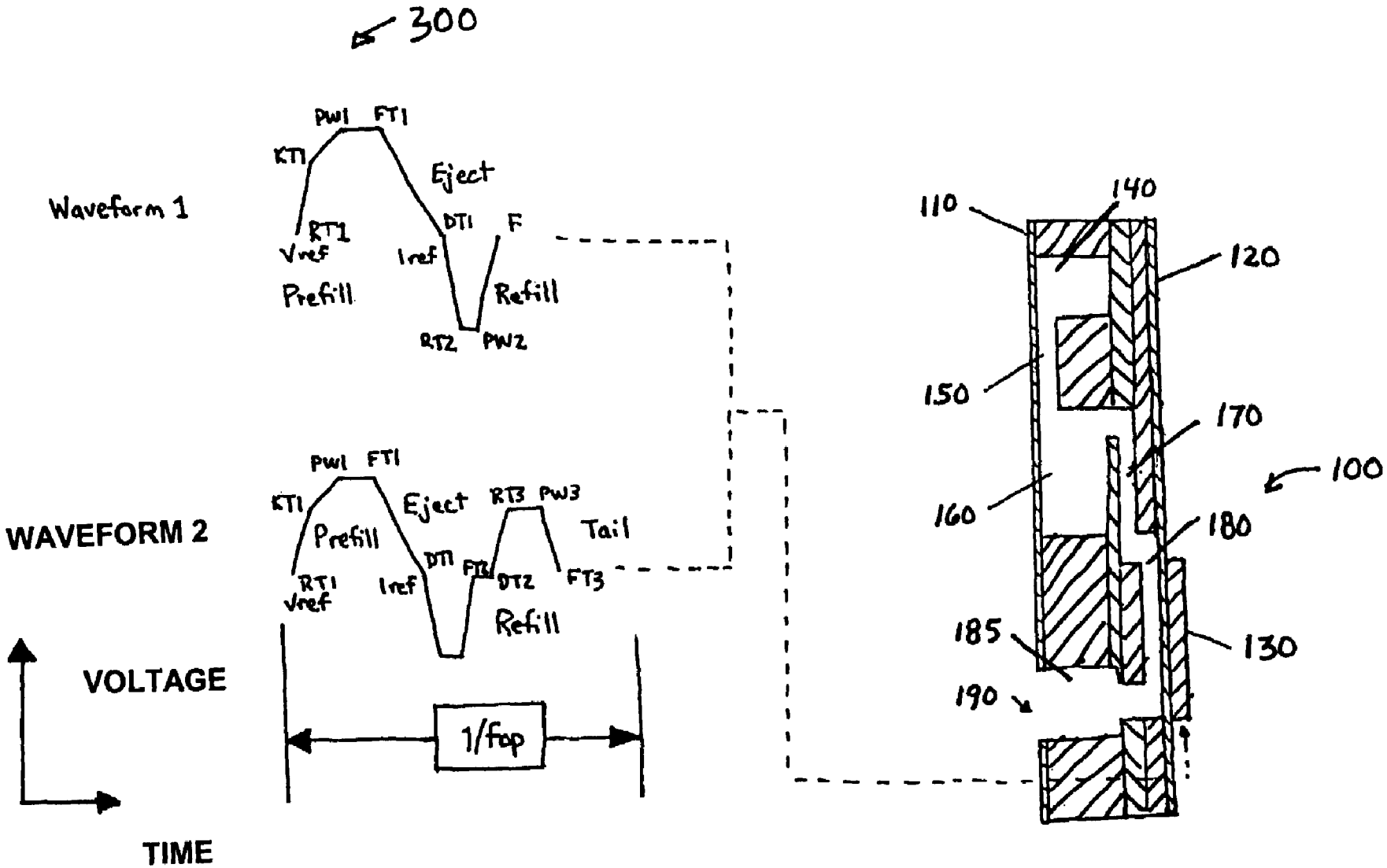
FIG. 2 illustrates a cross-sectional view of an exemplary ink nozzle array driven by one of two dual-drop full frequency waveforms to achieve either a large or small drop mass size.

In the exemplary embodiment of FIG. 2, printhead 100 of a printer 400 (shown in FIGS. 3-4) includes an aperture plate 110 and a diaphragm plate 120. A piezoelectric transducer 130 is provided on the diaphragm plate 120. An array of apertures 190 forming individual fluid nozzles is defined on the aperture plate 110. The array is closely and uniformly spaced with a predetermined spi (spot per inch) resolution. The apertures 190 are connected to a fluid source through various channels.

A suitable fluid, such as a phase-change solid ink that has been heated to liquid form, flows to an ink manifold 160 from an inlet port 140 through feed line 150. Ink from manifold 160 flows through an inlet 170 to a pressure chamber 180 where it is acted on by transducer 130, such as a piezoelectric transducer. Piezoelectric transducer 130 is driven by a printhead driver 300, which applies a particular waveform that deforms transducer 130 to displace an amount of ink within the pressure chamber 180 through outlet 185. Ultimately this amount of ink is forced through apertures 190 to eject a predetermined mass of ink from the printhead 100. Reverse bending of transducer 130 following ejection causes a refill of ink into the pressure chamber 180 to load the chamber for a subsequent ejection cycle.

In certain exemplary embodiments, the geometry of each aperture 190 and outlet 185 of each nozzle in the printhead 100 is common to all fluid nozzles. However, by application of a repeating sequence of two different full wavelength waveforms, a pattern of two different drop sizes can be produced from this common printhead nozzle geometry. In other exemplary embodiments, a pattern of different drop sizes can be achieved through application of a common full length waveform and different printhead nozzle geometries. In other exemplary embodiments, a pattern of different drop sizes can be achieved through interlacing of consecutive passes using a different waveform for each pass.

Printhead 100 can be manufactured as known in the art using conventional photo-patterning and etching processes in metal sheet stock or other conventional or subsequently developed materials or processes. The specific sizes and shapes of the various components would depend on a particular application and can vary. The transducer can be a conventional piezoelectric transducer. One common theme in all exemplary embodiments is that a pattern of alternating drop sizes is formed globally on a page or sub-page output through suitable selection of full length drive waveform and nozzle geometry.

Figure 3:
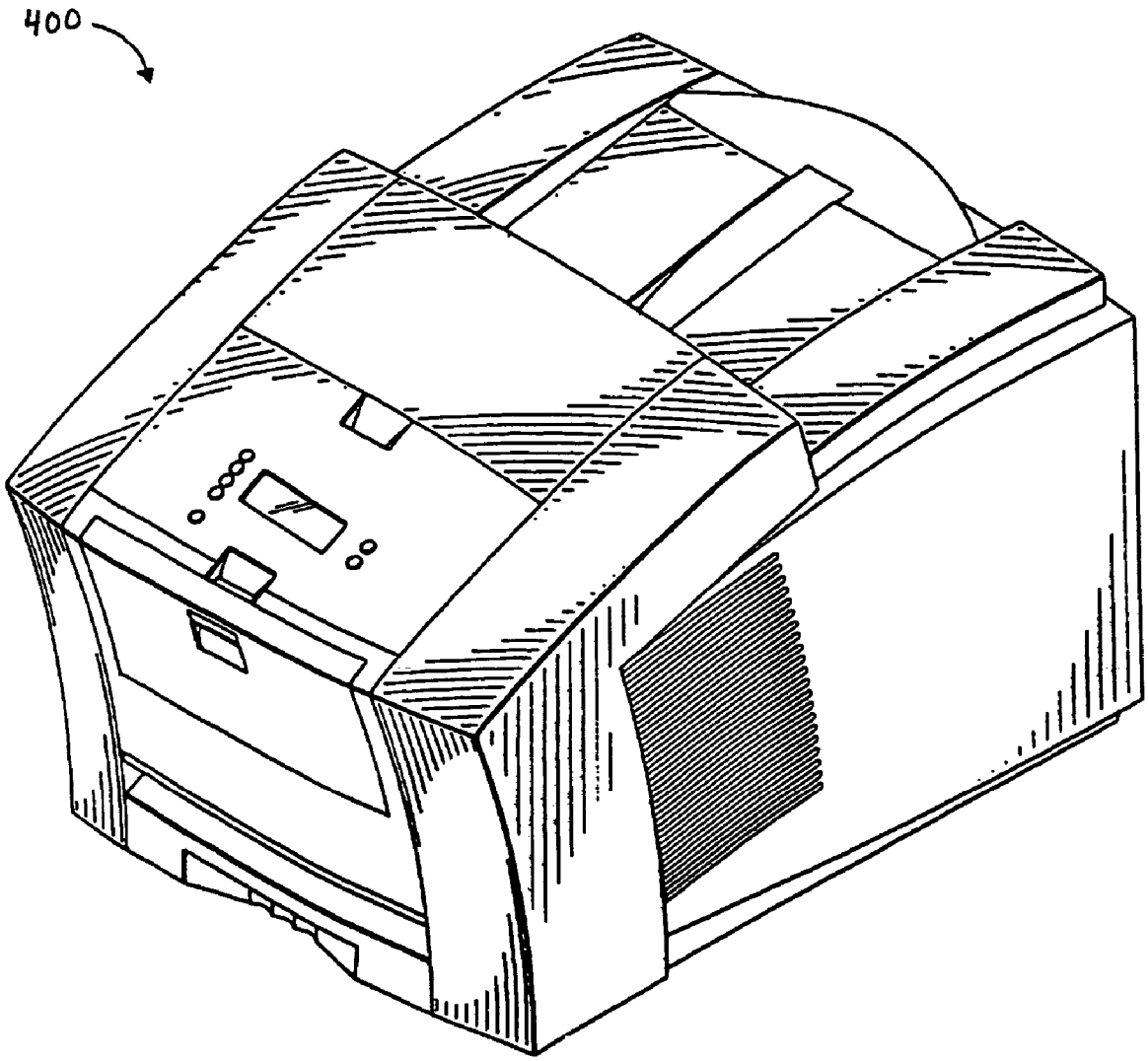
FIG. 3 illustrates a perspective view of an exemplary fluid ejection device.
Figure 4:
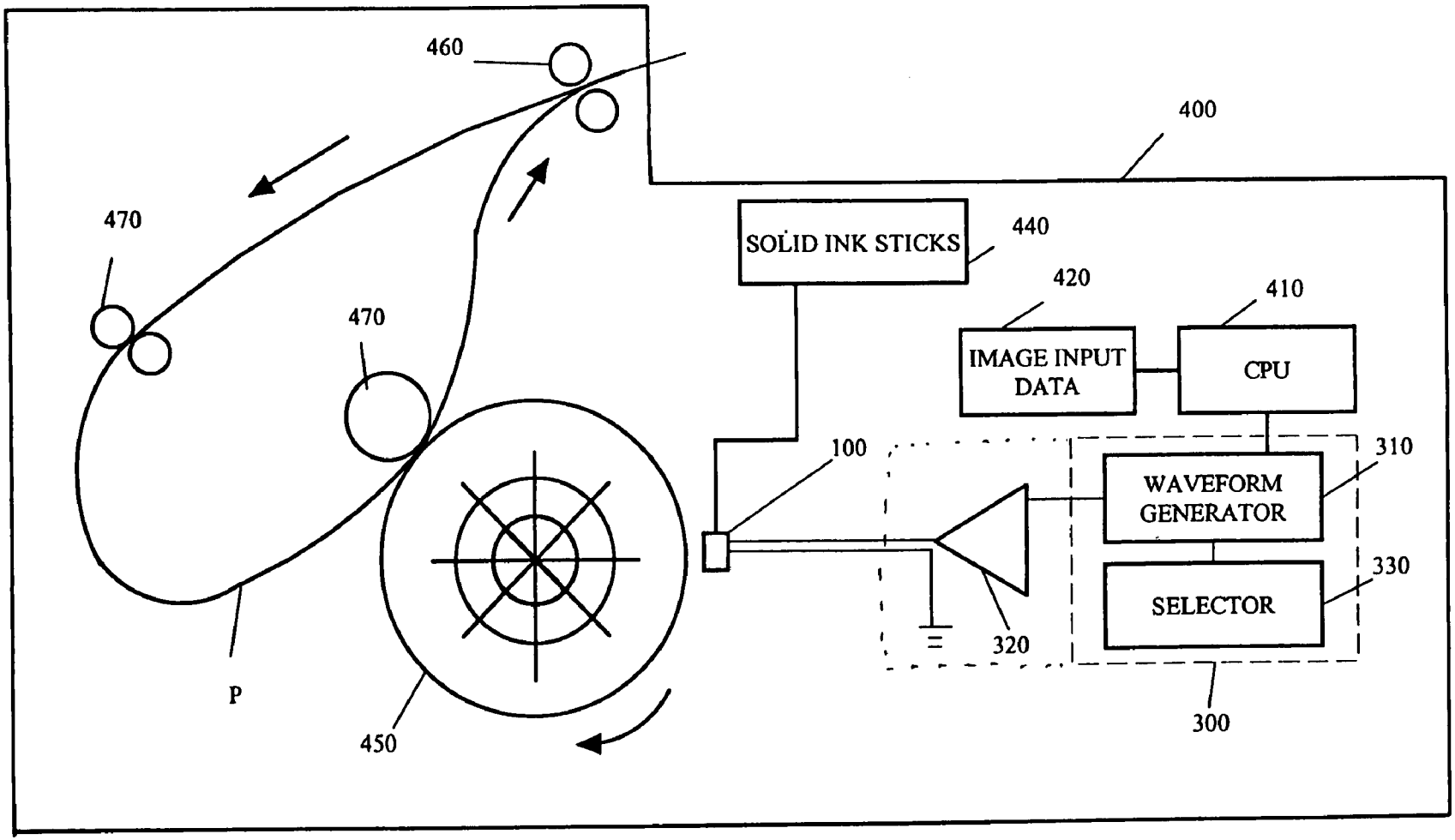
FIG. 4 illustrates a schematic block diagram showing the exemplary fluid ejection device of FIG. 3 having an apparatus used to generate the piezoelectric drive waveforms of FIG. 2.
Figure 5:
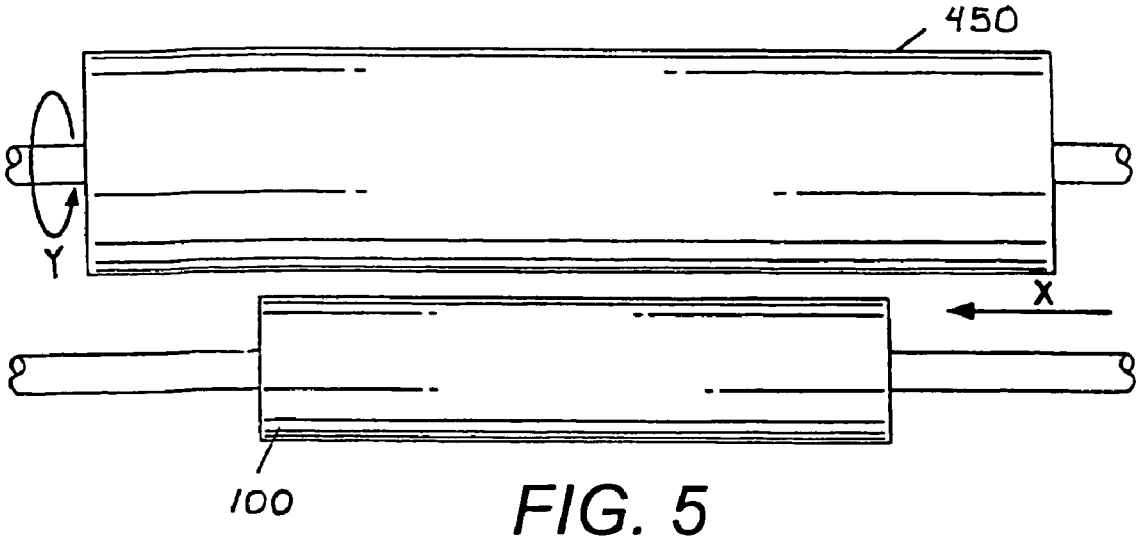
FIG. 5 illustrates a top pictorial view showing a printhead mounted to a shaft for translational X-axis movement while an adjacent drum supporting an intermediate transfer surface is rotated about a Y-axis.

An exemplary printer is a solid-ink offset printer 400 shown in FIGS. 3-5. In an offset printing system, the printhead 100 jets a fluid, such as phase-change solid ink, onto an intermediate transfer surface, such as a thin oil layer on a drum 450. A final receiving medium, such as a sheet of paper P, is then brought into contact with the intermediate surface where the image is transferred. In a typical offset printing architecture, the printhead 100 translates in an X-direction, as better shown in FIG. 6, while the drum rotates perpendicularly along a Y-axis. Typically, the printhead 100 includes multiple jets configured in a linear array to print a set of scan lines on the drum 450 during each rotation of the drum. Precise movement of the X-axis and Y-axis translation is required to avoid unnecessary artifacts. This can be achieved, for example, using a print head drive mechanism such as the ones described in U.S. Pat. No. 6,244,686 to Jensen et al. and U.S. Pat. No. 5,389,958 to Bui et al., the subject matter of which is hereby incorporated herein by reference in its entirety.

Ejecting ink drops having dual controllable volume/mass is achieved by printhead driver 300, which is better illustrated in FIG. 4. Driver 300 is provided within printer 400 and includes a waveform generator 310 capable of generating multiple waveform patterns. As shown in FIG. 2, exemplary embodiments provide at least two selectable full wavelength patterns (waveform 1 and waveform 2). Transducer 130 responds to the selected waveform by inducing pressure waves in the ink that excite ink fluid flow resonance in outlet 185. A suitable waveform is selected using selector 330, based on criteria to be described later in more detail. The waveform selected is fed to amplifier 320. From amplifier 320, an amplified signal is delivered to the piezo transducer of printhead 100, driving one or more rows of jets in the printhead. Movement of the piezo transducer causes ejection of a suitable volume of fluid, such as ink, from printhead 100 of printer 400 based on image signals received from a source (such as a scanner or stored image file) in image data input 420 and controlled by CPU 410 of the printer.

Ink is provided in a storage area 430 and supplied to printhead 100 through an ink loader 440. In an exemplary embodiment, printer 400 is a solid ink printer that contains one or more solid ink sticks in storage area 430. The solid ink sticks are melted and jetted from ink jet nozzles of the printhead 100 onto the intermediate transfer surface on drum 450, which may be rotated one or several revolutions to form a completed intermediate image on the transfer surface on the drum. At that time, a substrate, such as paper, can be advanced along a paper path that includes roller pairs 460, 470 and between a transfer roller 470 and drum 480, where the image is transferred onto the paper in a single pass as known in the art.

A different resonance mode may be excited by each full wavelength waveform to eject a different drop volume/mass in response to each selected mode. In the FIG. 2 example, one waveform (waveform 1) may provide a small drop size, while the other waveform (waveform 2) may provide a large drop size when driving jet nozzles having the same nozzle geometry. The waveform design chosen would be based on the design constraints of the fluid pathway, the transducer operating parameters, the meniscus parameters of the fluid, and the like. Selection of modal properties can be determined by empirical modeling or experimentation based on known governing principles. For example, details of the equations governing fluid dynamics relevant to fluid ejection can be found in U.S. Pat. No. 5,495,270 to Burr et al., the subject matter of which is hereby incorporated herein by reference in its entirety. From these and other conventional teachings, one of ordinary skill can select appropriate full length waveforms to produce a desired droplet size.

Alternatively, different drop volume/mass may be achieved by use of one of the two waveforms and nozzles in the array having different geometries, such as aperture size, shape, etc. Thus, by creating the array with nozzles that are arranged in a pattern so that first and second drop sizes are formed when applied with the same full wavelength waveform, the same effect can be achieved. However, because the nozzle geometry cannot be changed readily without replacement of the array, this alternative cannot have the resultant pattern changed as easily as embodiments that use a common nozzle geometry and simply change the pattern through selection of different drive waveforms.

An important aspect of the disclosure is in the control of the full length waveforms globally on a page or partial page basis so that printhead 100 drives various rows of nozzles with a particular pattern of alternating large and small ink drops on a page to achieve benefits of each size drop. That is, a whole page does not need to be printed using only a single drop size, but instead achieves a pattern incorporating both drop sizes so that advantages to use of each size can be realized.

Various different patterning techniques are disclosed. For example, the embodiments of FIGS. 7-11 achieve alternating rows of large and small drops on a page or sub-page basis. The embodiments of FIGS. 12-14 and FIGS. 15-17 achieve alternating columns of large and small drops. In various exemplary embodiments, the pattern layout is for an entire page. In further exemplary embodiments, the pattern can change on a sub-page basis or in consecutive passes.

Figure 6:
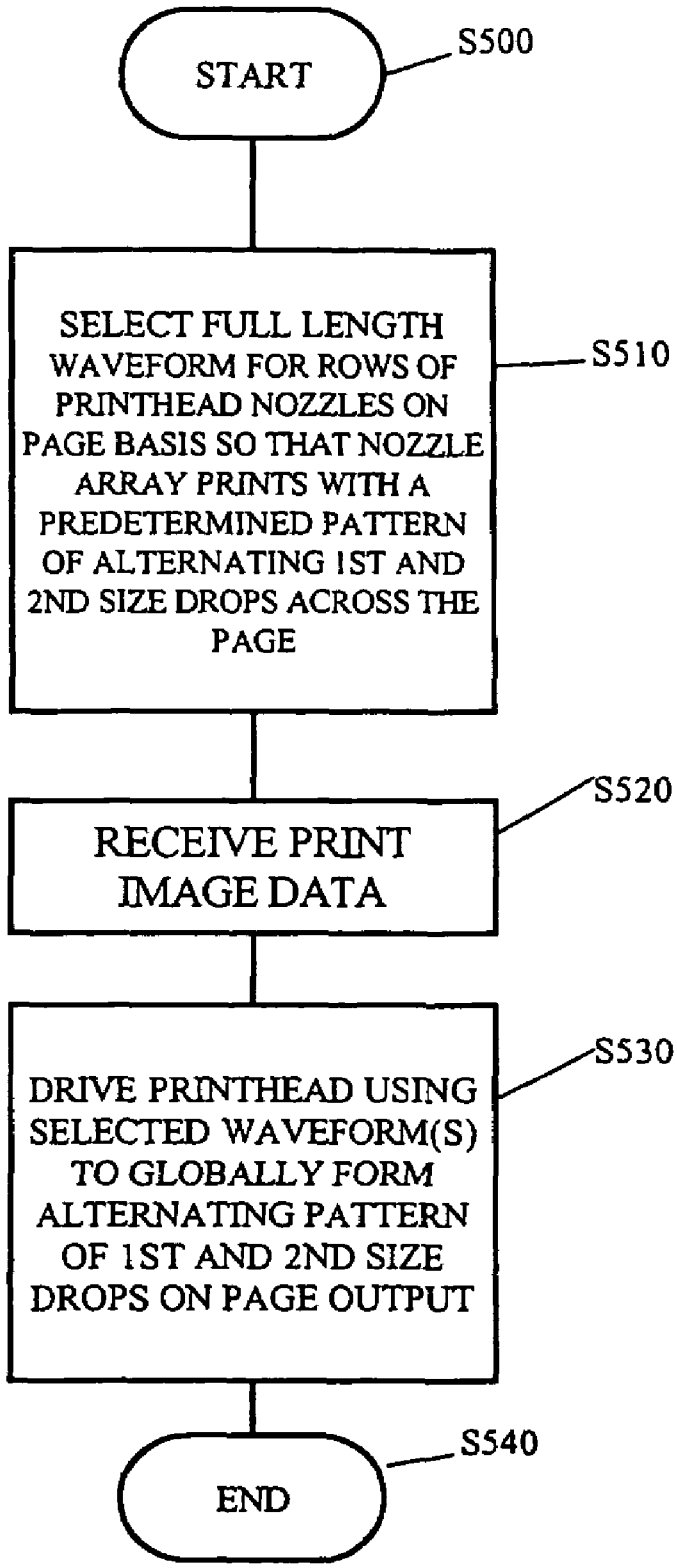
FIG. 6 illustrates an exemplary flowchart showing a method for generating a page output from a printer having an alternating pattern of large and small ink drops.

A basic generalized method of printing using the printhead and driver of FIGS. 2-5 will be described with reference to FIG. 6. The process starts at step S500 and advances to step S510 where selector 330 of driver 300 selects appropriate full length waveform pattern(s) to drive the nozzle array with to achieve a predetermined pattern of first and second drop sizes on a page. From step S510, flow advances to step S520 where page image data is received. From step S520, flow advances to step S530, where driver 300 drives the nozzle array based on the page image data and based on the predefined waveform (s) selected to output an image in which the page globally forms an alternating pattern of first and second drop sizes on the page output. The process then ends at step S540.

Alternatively, the step of receiving image data can be performed prior to selection of waveform pattern by selector 330. This could, for example, take into account global properties of the received image and use this information to determine which global page-based or sub-page based pattern of large and small drops would produce better image quality. For example, if the image data is determined to be primarily solid fill, one pattern with a more dominant mix of large drops may be better than another pattern. Likewise, an image with a lot of light fill areas may have better print quality if a pattern with more dominant small drops is present. Moreover, based on the image and resolution details, it may be preferable to have the pattern aligned in rows or columns to take into account x-resolution or y-resolution problems with a particular printer architecture. Thus, although certain embodiments have a 1:1 ratio of large to small drops globally, various patterns may have differing proportions, such as 2:1; 3:1; 5:3, etc. More specific examples of these will be described with reference to the following embodiments.

A first specific embodiment will be described with reference to FIGS. 7-11 and achieves printing of an image with a pattern of small and large drops arranged in horizontal rows. It is achieved using an ink jet nozzle array having common nozzle geometry and use of two different full length waveforms to achieve the different drop size.

Figure 8:
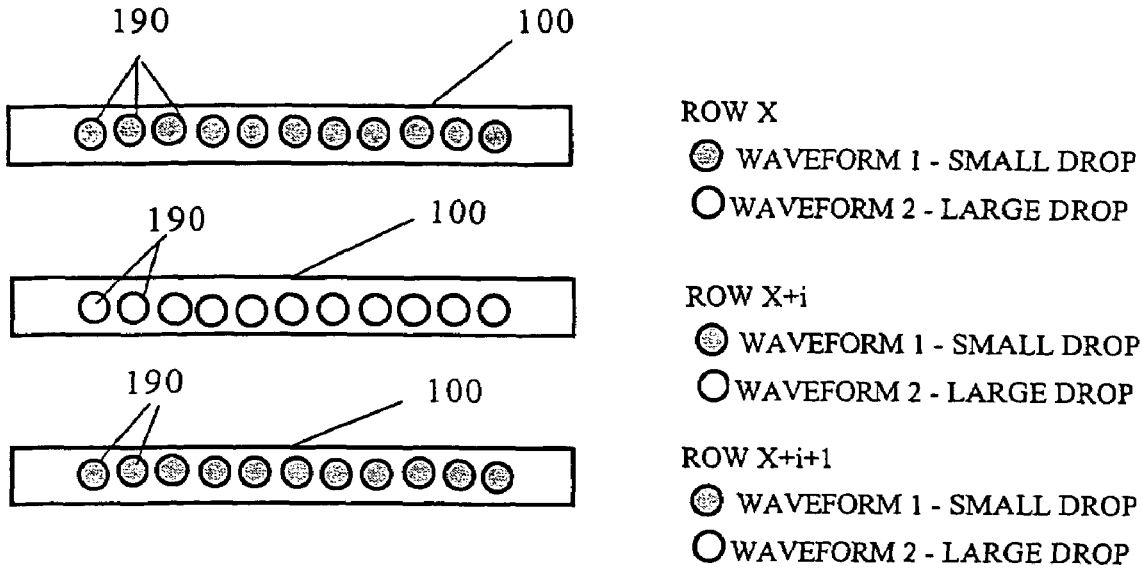
FIG. 8 illustrates consecutive printhead cycles or rows of printheads driven by the method of FIG. 7.
Figure 9:
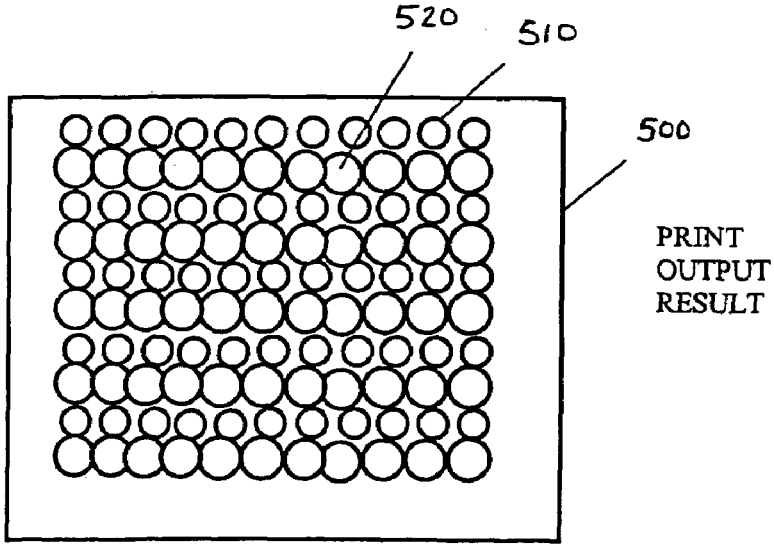
FIG. 9 illustrates an exemplary dual drop printing output in accordance with the method of FIG. 7 and printhead configuration of FIG. 8 in which every other line (row) is printed with small drops.

For simplicity, the process will be discussed in terms of generating a solid fill image. This will demonstrate the global dropmass grid of which the printer imaging will know and will utilize in the actual color image formation. The process starts at step S600 and flows to step S610 where a waveform pattern is selected to achieve alternating rows of at least two different drop sizes (large and small). From step S610, flow advances to step S620 where page image data is received that corresponds to a specific input image to be reproduced. From step S620, flow advances to step S630 where select printhead nozzles in row X are each driven using the same full wavelength waveform 1 to form a row X of first sized ink drops. For example, as shown in FIGS. 8-9, a single array of nozzles 190 provided on printhead 100 can have a common nozzle geometry and be driven in a first cycle such that all nozzles corresponding to the image are driven with waveform 1 to achieve a row X of small ink drops 510.

From step S630, flow advances to step S640, where row X+i is driven using full length waveform 2 to form row X+i having second, different size drops 420. For example, in FIG. 8, during a second cycle, the single array 190 of printhead 100 is driven with waveform 2 such that all nozzles corresponding to the image are driven to achieve a row X+i of large drops. From step S640, flow advances to step S650, where additional rows are printed using the pattern of waveforms so that alternating rows of first and second ink drops are formed on a page output 500 as better shown in FIG. 9.

This method can also be performed using a two-dimensional array of nozzles that are driven at the same time. This is achieved by driving each individual row of nozzles with one of the two waveforms sequentially to achieve a desired pattern of alternating rows of large or small drops.

Printing with this method can be performed to achieve one-half the print area with small drops and one-half the print area with large drops. Such patterning achieves benefits of using each drop size, and does not suffer the problems associated with using only a single drop size. That is, by alternating between two different waveforms in a predetermined pattern over the entire image print frequency can be maximized to improve print speed and full length waveforms can be used. Moreover, by using both drop sizes on a page in this alternating manner, benefits attributed to each drop size can be realized to improve image quality at both solid fill and light fill regions of an image. Thus, the quality/speed tradeoff can be lessened.

Figure 10:
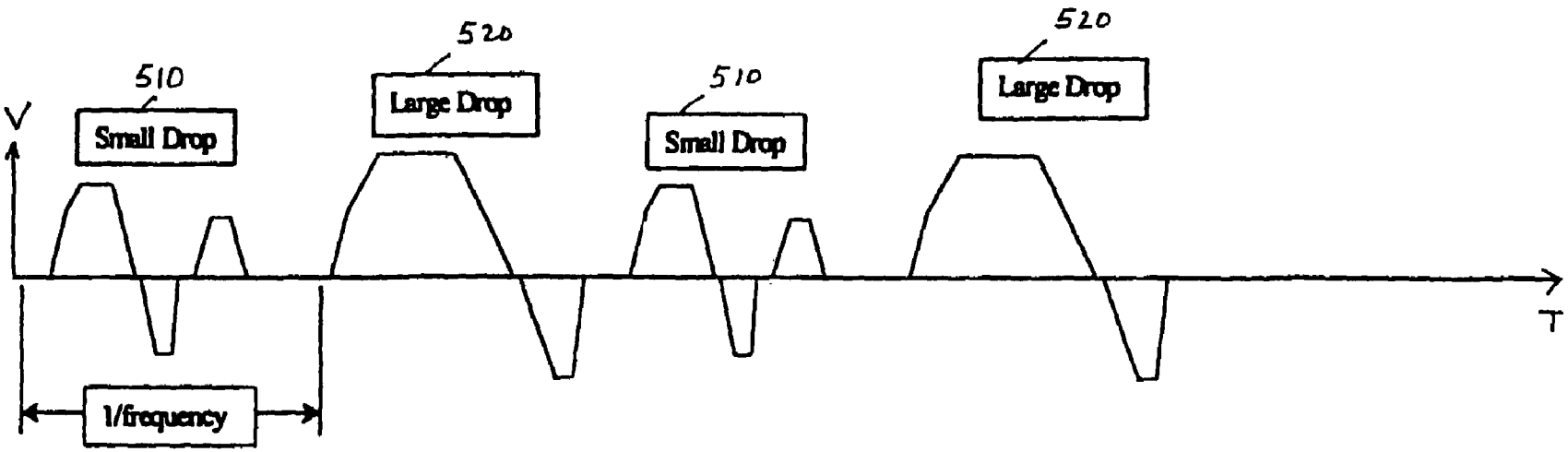
FIG. 10 illustrates an exemplary waveform diagram according to the method of FIG. 7.

As shown in FIG. 10 for an individual nozzle of the array driven in consecutive cycles, each nozzle would be driven by alternating waveforms to produce a small drop 510, a large drop 520, a small drop 510, and a large drop 520 in sequence. This method offers a substantially different set of design opportunities compared to those available when only considering ½ length waveforms. Moreover, because the pattern of large and small drops is globally set, image processing can be simplified, while the patterning of large and small drops achieves advantages to use of each size to images across the page.

Figure 7:
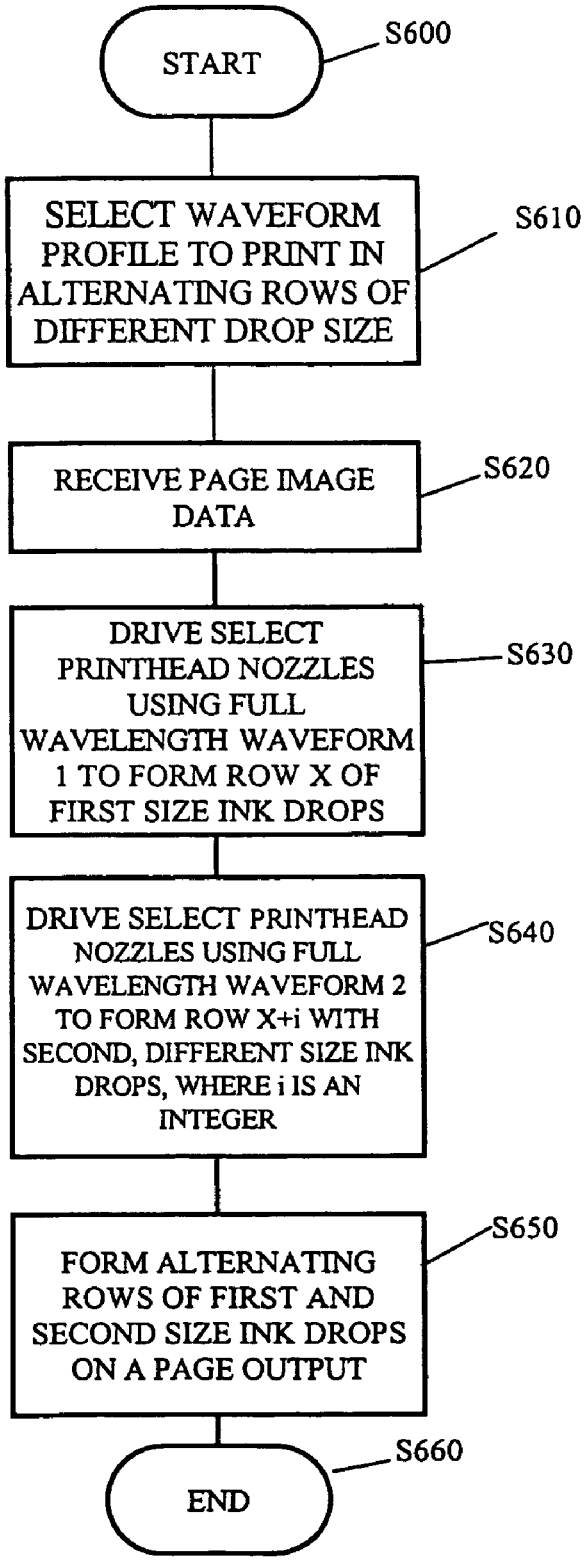
FIG. 7 illustrates a flowchart of a specific exemplary embodiment for generating a page output from a printer having an alternating pattern of large and small ink drops arranged in alternating rows.
Figure 11:
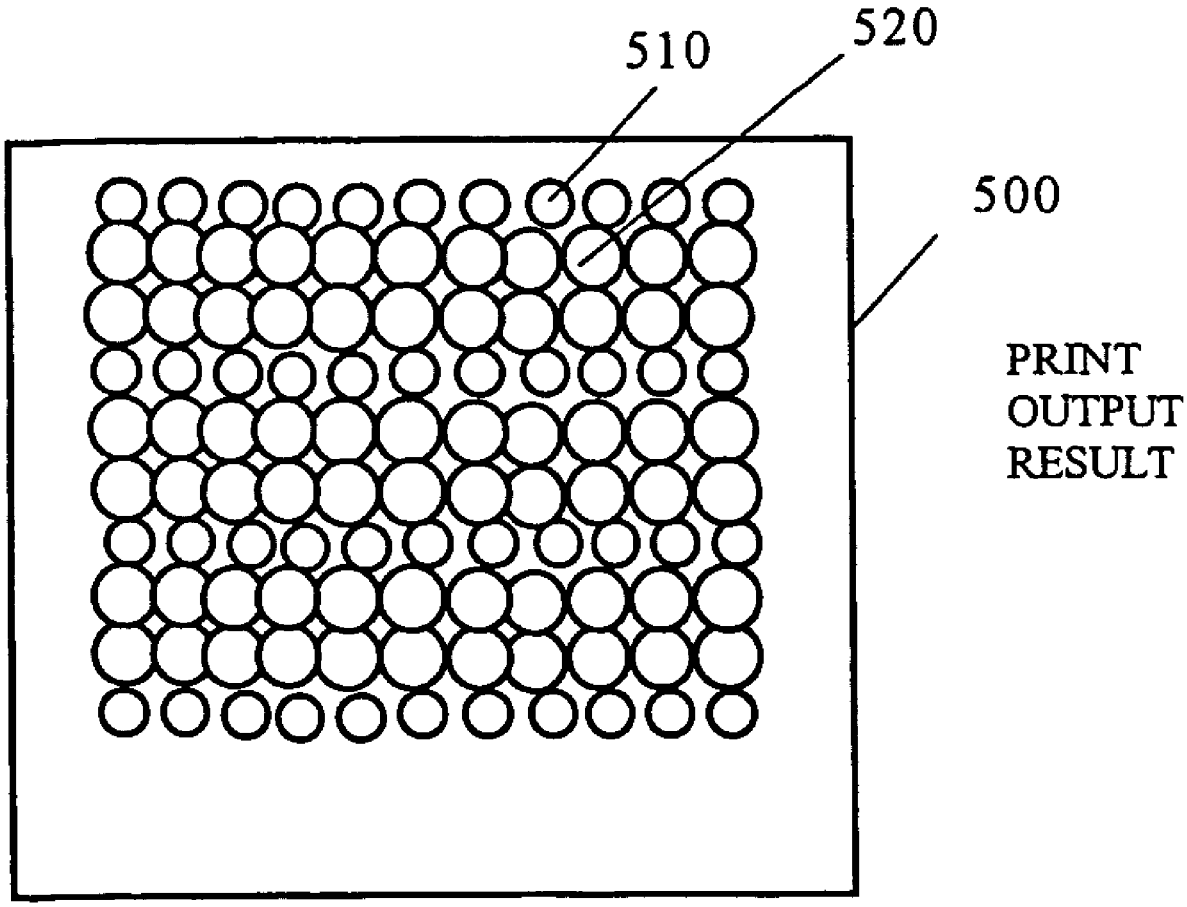
FIG. 11 illustrates an exemplary dual drop printing output in accordance with a modified version of the method of FIG. 7 in which a multiple number of rows of large drops are alternated with rows of small drops.

FIG. 11 shows a modified version of the method of FIG. 7 in which a multiple of sequential rows are printed with a same drop size so that the pattern is more dominant with either the first drop size or the second drop size. In the FIGS. 8-9 example, there is a 1:1 ratio of large to small drops. However, it may be desirable to adjust the ratio so that one size is more dominant. An example of this is shown in FIG. 11, where a 2:1 ratio of large to small drops is achieved by printing row 1 in cycle 1 using the small droplet waveform 1 while both rows 2 and 3 are driven by waveform 2 to provide two consecutive rows of large drops. Then, cycle 4 repeats to provide a row of small drops. Other ratios of 3:1, 4:1, 5:2, etc. can be substituted and can be dominant with either the small drop size or the large drop size. The ratio does not necessarily have to remain the same over the entire image, but must remain set for each drum revolution. Therefore, depending on the jet spacing and resolution, even hybrid patterns composed of columns of the pattern in FIG. 9 and other columns of the pattern shown in FIG. 11 are possible. The actual implementation of which would be optimized to achieve various benefits. For example, a higher ratio of small drops may improve printing of light fill images, whereas a higher ratio of larger drops may improve solid fill dropout. Additionally, modifying the pattern in a second direction (say a slightly offset pattern for every other column) could be used to additionally reduce some repetitive patterning if banding and/or modeling of the image is discovered. Such things must typically be determined empirically, but can be readily performed by anyone skilled in the art.

Figure 12:
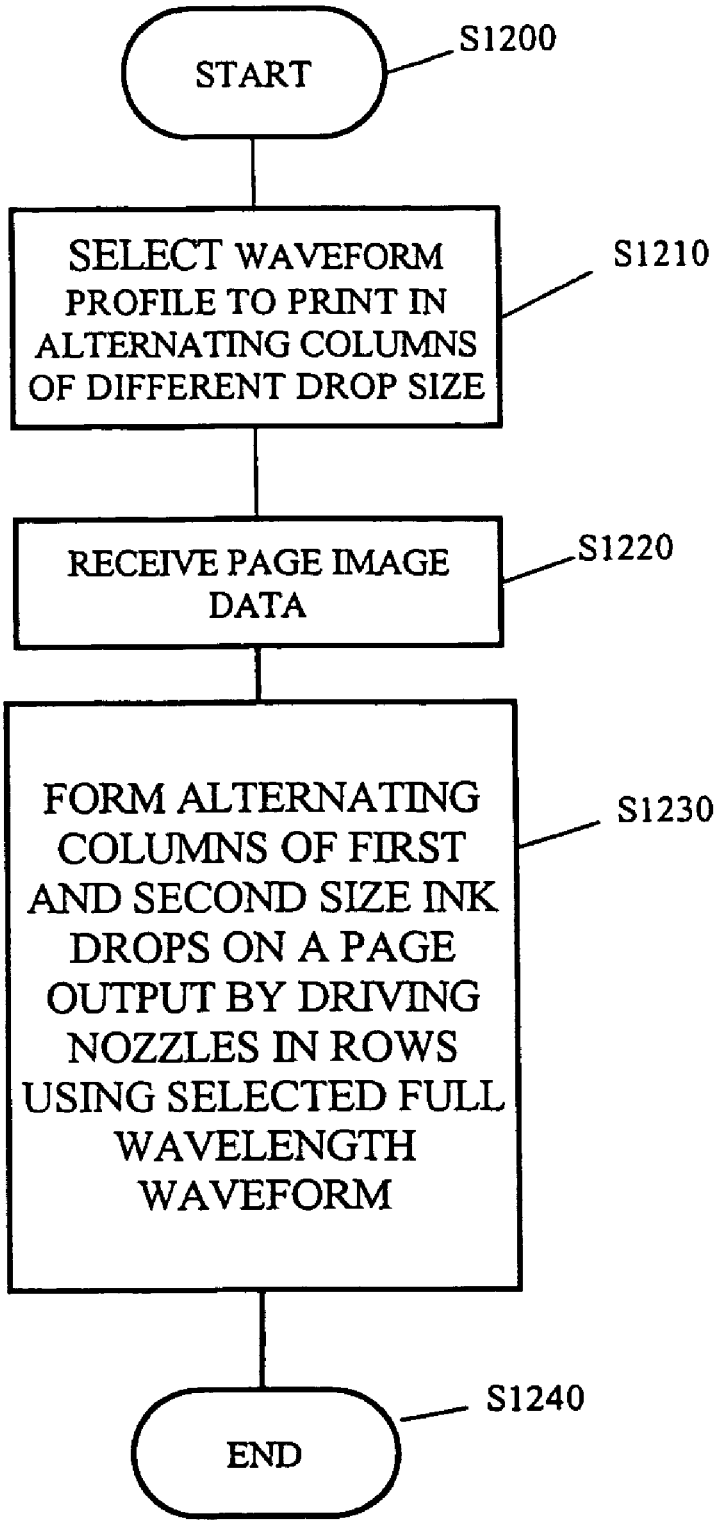
FIG. 12 illustrates a flowchart of a specific exemplary embodiment for generating a page output from a printer having an alternating pattern of large and small ink drops arranged in alternating columns.
Figure 13:
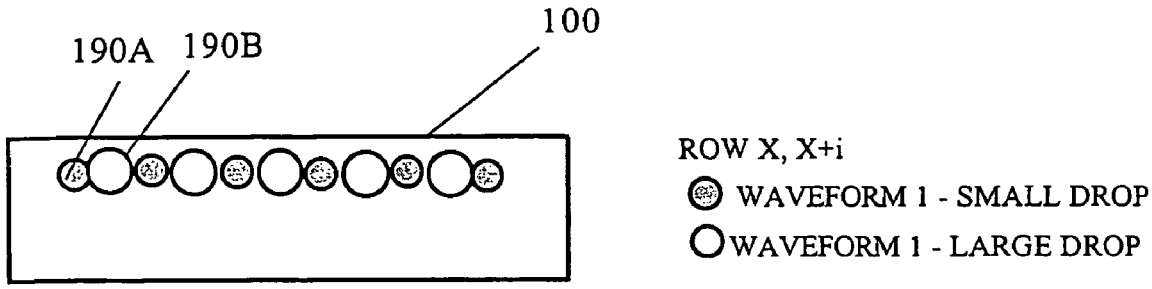
FIG. 13 illustrates consecutive printhead cycles or rows of printheads driven by the method of FIG. 12.
Figure 14:
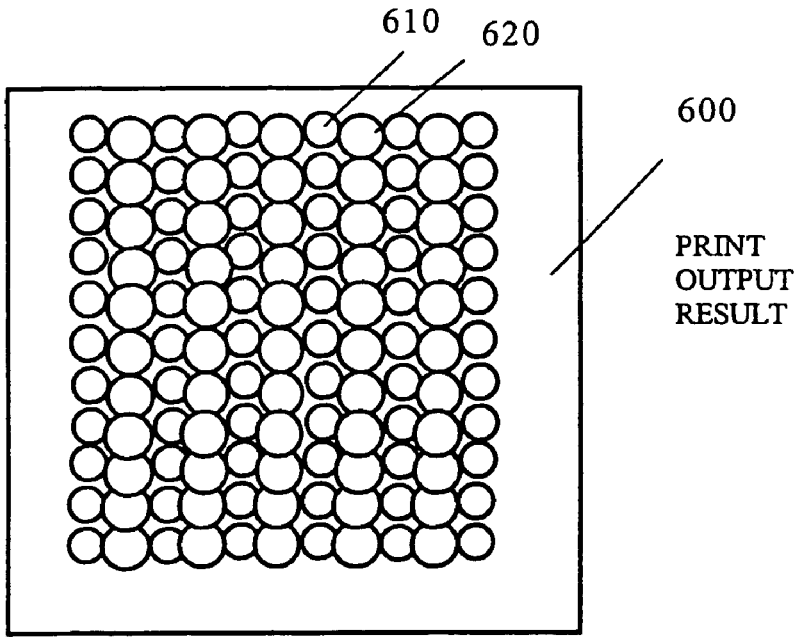
FIG. 14 illustrates an exemplary dual drop printing output in accordance with the method of FIG. 12 and printhead configuration of FIG. 13 in which every other column is printed with small drops.

Another embodiment will be described with reference to FIGS. 12-14 and achieves printing of an image with a pattern of small and large drops arranged in vertical columns. The process starts at step S1200 and flows to step S1210 where a waveform pattern is selected to achieve alternating columns of at least two different drop sizes (large and small). From step S1210, flow advances to step S1220 where page image data is received that corresponds to a specific input image to be reproduced. From step S1220, flow advances to step S1230 where select printhead nozzles in rows X and X+i are driven using the selected full wavelength waveform (waveform 1 or waveform 2) to form alternating first and second drop sizes for the rows. For example, an array of nozzles provided on printhead 100 can be driven with a same waveform. However, as shown in FIG. 13, alternating nozzles in the array have a different nozzle geometry. For example, nozzle 190A has a smaller nozzle diameter than nozzle 190B. Because of this difference in geometry, even when applied with the same full wavelength waveform, the output from the array achieves a row of alternating small and large ink drops as shown in FIG. 14. From step S1230, flow advances to step S1240, where the process ends.

This process achieves the output image shown in FIG. 14 in which the small drops and large drops are aligned vertically into alternating columns. As with the previous embodiment, it is possible to alter the ratio to be other than a 1:1 ratio of large and small drops. This can be achieved, for example, by replacing the array with an array having a different distribution of large and small nozzles.

A third exemplary embodiment will be described with respect to FIGS. 15-18. In this embodiment, a full width offset printer 400 is provided that uses line interlacing to create an image on intermediate transfer surface on drum 450 with an alternating pattern of large and small drops. For a more detailed description of line interfacing, see U.S. Pat. No. 5,734,393 to Eriksen and U.S. Pat. No. 5,949,452 to Jones, the subject matter of which is hereby incorporated herein by reference in its entirety.

In this embodiment, printhead 100 includes an array of nozzles 190 that are spaced in the X-direction by a value nX, where n is an integer and X is a pixel width. During printing, drum 450 rotates in the direction of arrow Y (FIG. 5). As the drum rotates, the printhead translates along the X-axis and a plurality of ink jets eject ink onto the intermediate transfer surface supported by drum 450. One rotation of the drum and simultaneous translation of the printhead 100 while firing the jets results in the deposition of a set of very slightly angled vertical scan lines on the intermediate transfer surface on drum 450. One scan line has an approximate width of one pixel. A set of scan lines corresponds to one rotation of the drum 450 (one line for each jet in the array). Therefore, the inter-jet spacing nX dictates the number of rotations of the drum that must occur to create a full image at a given resolution. For example, in the illustrative FIGS. 15-17, an inter-jet spacing of 2X is provided. Thus, two rotations are needed to form a complete solid fill image. However, other interlacing could be used. For example, an inter-jet spacing of 10X would require 10 rotations of the drum to produce a solid fill image.

Each column could contain a single nozzle, in the case of a monochrome printer, or four nozzles as shown in the case of a color printer (one for each of cyan, magenta, yellow and black). Although only six columns are shown, the array would extend the full width of the drum and in actuality would contain a much larger number of columns.

Figure 16:
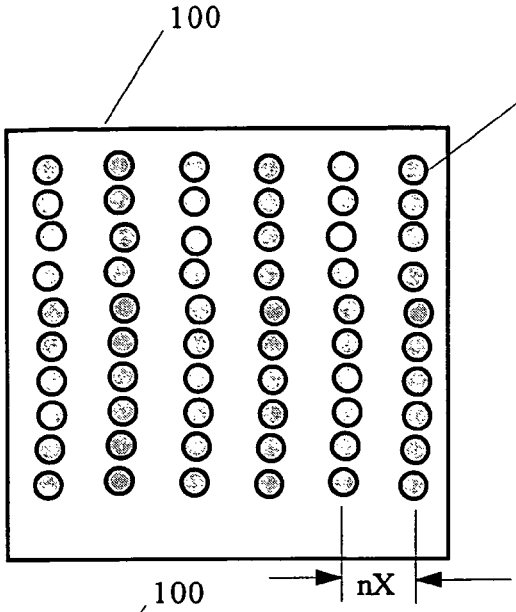
FIG. 16 illustrates a first printhead cycle, during a first rotation of an intermediate drum, in a full width printhead driven by the method of FIG. 15.
Figure 17:
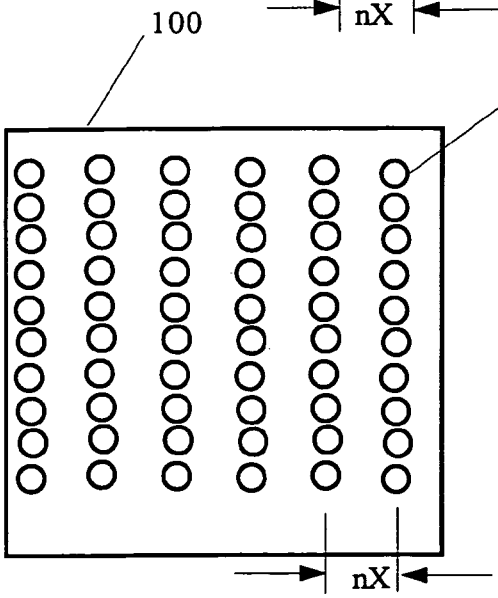
FIG. 17 illustrates a second printhead cycle, during a subsequent rotation of the intermediate drum, in a full width printhead driven by the method of FIG. 15.
Figure 18:
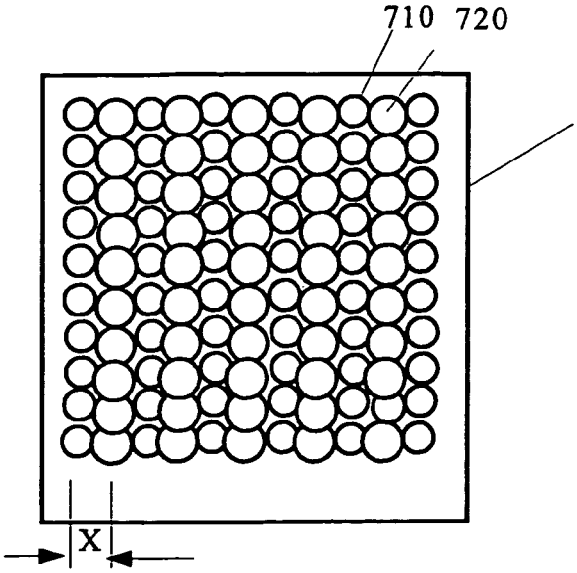
FIG. 18 illustrates an exemplary dual drop printing output in accordance with the method of FIG. 15.

In this embodiment, driver 300 is capable of driving the array with a different full width wavelength during each rotation of intermediate drum 450. For example, during a first rotation shown in FIG. 16, waveform 1 can be applied to each driven nozzle to form a series of small ink drops 710 shown in FIG. 18. Then, during a second rotation as shown in FIG. 16, waveform 2 can be applied to each driven nozzle to form a series of large ink drops 720 shown in FIG. 18. Because the printhead 100 is translated in the X direction, the second rotation produces drops that are laterally displaced relative to drops ejected during the first rotation. This could be achieved by incremental translation in the X-direction during rotation of the drum in the Y-direction. Alternatively, translation can occur in a single step at the end of each drum revolution, such as while the printhead is over an interdocument region of the drum 450. Thus, in this simple example with an inter-jet spacing of two pixels, alternating between waveform 1 and waveform 2 for consecutive revolutions of the drum 450 results in alternating columns of small and large drops as shown in FIG. 18. For a given inter-jet spacing, ratios of large to small drops can be varied to values other than 1:1, through careful selection of which waveform to use during each drum revolution. This selection would change depending on the resolution and interlace, but is known a priori. As described in previous embodiments, this would allow for adjustments to make either the large or small drops more dominant to adjust image quality. In a preferred embodiment, adjustment to the waveform (i.e., changing between waveform selections), would take place during an interdocument spacing zone on the drum when no printing occurs.

Figure 15:
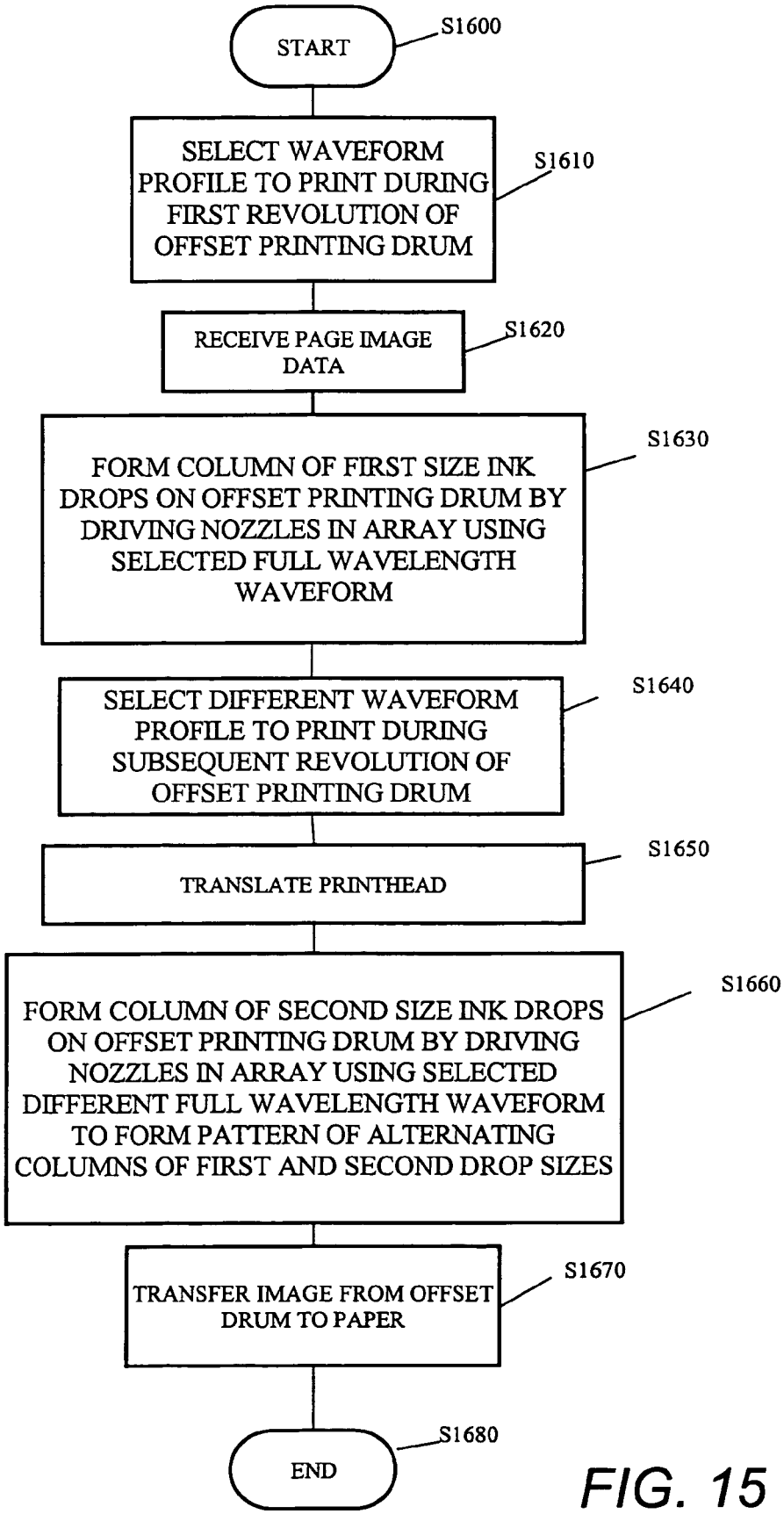
FIG. 15 illustrates a flowchart of a specific exemplary embodiment for generating a page output for a printer having an alternating pattern of large and small drops arranged in alternating columns.

An exemplary method of printing using the offset printer 400 will be described with respect to FIG. 15. The process starts at step S1600 and proceeds to step S1610 where a waveform profile is selected to be used during a first revolution of the offset printing drum to drive the array of nozzles 190. From step S1610, flow advances to step S1620 where page image data is received. At step S1630, a column (typically a series of spaced columns) of first size ink drops is printed on the drum during a first revolution of the drum by driving the nozzle array using the selected full wavelength profile. From step S1630, flow advances to step S1640 where a different waveform profile is selected for use during a subsequent revolution of the offset printing drum to drive the nozzles to produce second, different size ink drops. From step S1640, flow advances to step S1650 where the printhead is translated in the X-direction by a specified amount. From step S1650, flow advances to step S1660 where a column of second size ink drops is formed on the offset printing drum laterally offset from the previously formed column to form a pattern of alternating columns of first and second ink drop sizes. From step S1660, the process advances to step S1670 where the image formed on the offset printing drum is transferred to a paper substrate, preferably in a single pass. From step S1670, flow advances to step S1680 where the process stops.

The specific drop size used for the large and small drops would depend on various criteria, including the resolution of the printhead, properties of the ink and transfer process, etc. A large drop in exemplary embodiments useful in a monochrome or color solid ink-based piezo fluid ejector or printer is set to about 31 ng or higher, but would depend on several considerations, including a desired small drop size, ink dye loading, etc.

A small drop requirement should be less than about 24 ng, and preferably in the range of around 10-20 ng. Therefore, in preferred embodiments using solid ink-based fluid ejectors, the nozzle geometry and/or waveform(s) selected would be chosen to provide and alternating pattern of large and small ink drops where the large drop is set to be about 31 ng, and the small drop is set to be less than 24 ng, preferably 10-20 ng. This combination of drop size has been found to achieve acceptable text quality, improve light fill areas and reduce graininess as well as improve image transfer and maximize print speed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for ejecting at least two different fluid drop sizes of a same fluid from a fluid ejector nozzle array in accordance with a page patterning methodology, comprising:

receiving image data for at least a page of data;

analyzing the received image data globally on a page by page basis to set a predetermined repeating alternating pattern of first and second drop sizes globally for each page that optimizes overall image quality for each particular page, the predetermined repeating alternating pattern set being selected from a pattern having a ratio of first to second drops in the pattern approximately 1:1 and one or more patterns having a ratio of first to second drops in the pattern substantially different from 1:1 so that one particular drop size is dominant in the pattern;

selecting a particular full length waveform to drive each individual nozzle of the array to eject the set predetermined repeating alternating pattern of first and second different drop sizes of the same fluid across an output page for the entire page;

driving the nozzle array using the set repeating alternating pattern to eject fluid based on the received image data to print the image data on the output page using the repeating alternating pattern containing both the first and second drop sizes set for that particular output page based on the global analysis of the received image data for that page, wherein the fluid nozzle array has a common nozzle geometry and the selecting selects from at least two different full length waveforms to eject the predetermined repeating alternating pattern of first and second different drop sizes.

2. The method according to claim 1, wherein the alternating pattern is arranged in alternating rows and/or columns of large and small drops.

3. The method according to claim 1, wherein a ratio of first and second drops in the pattern is set to be approximately 1:1 to optimize image quality for that particular page.

4. The method according to claim 1, wherein a ratio of first and second drops in the pattern is set to be substantially different from 1:1 so that one particular drop size is dominant in the pattern to optimize image quality for that particular page.

5. The method according to claim 1, wherein the fluid ejected is ink.

6. The method according to claim 1, wherein the large drop size has about twice the mass as the small drop size.

7. The method according to claim 1, wherein the large drop size is about 31 ng or higher and the small drop size is about 24 ng or less.

8. The method according to claim 7, wherein the small drop size is between about 10-20 ng.

9. The method according to claim 1, wherein when the global analysis determines that the page is primarily solid fill, the pattern selected is set to have a dominant mix of large drops in a ratio of at least 5:3 for the entire page and when the global image analysis determines that the page is primarily light fill, the pattern selected is set to have a dominant mix of small drops in a ratio of at least 5:3 for the entire page.

10. An apparatus for ejecting a fluid in a pattern of at least first and second different drop sizes of a same fluid in accordance with a page patterning methodology, comprising:

a fluid ejector nozzle array having a plurality of fluid nozzles, each having a defined nozzle geometry;

a fluid ejector driver capable of driving each individual nozzle with a selected full length waveform so that the array ejects a predetermined repeating alternating pattern containing both the first and second drop sizes of the same fluid across an output page;

an image data input that receives image data from a source; and a processor that analyzes the received image data globally on a page by page basis to set the predetermined repeating alternating pattern of first and second drop sizes globally for each page that optimizes overall image quality for each particular page, the predetermined repeating alternating pattern set being selected from a pattern having a ratio of first to second drops in the pattern of approximately 1:1 and one or more patterns having a ratio of first to second drops in the pattern substantially different from 1:1 so that one particular drop size is dominant in the pattern;

wherein the nozzle array is driven by the selected full length waveform based on the received image data to eject drops in accordance with the image data to print the image data on the page using the ejected fluid having the set repeating alternating pattern containing both first and second drop sizes, and the individual nozzles of the nozzle array have a common nozzle geometry and a waveform selector selects one of at least two different full length waveforms to drive each nozzle to achieve the repeating alternating pattern of first and second drop sizes.

11. The apparatus according to claim 10, wherein the apparatus is a printer.

12. The apparatus according to claim 11, wherein the printer is an ink jet printer.

13. The apparatus according to claim 11, wherein the printer is a solid ink printer.

14. The apparatus according to claim 10, wherein a ratio of first and second drops is set to be approximately 1:1.

15. The apparatus according to claim 10, wherein a ratio of first and second drops is set to be substantially different from 1:1 so that one particular drop size is dominant in the image.

16. The apparatus according to claim 10, wherein when the global analysis determines that the page is primarily solid fill, the pattern selected is set to have a dominant mix of large drops in a ratio of at least 5:3 for the entire page and when the global image analysis determines that the page is primarily light fill, the pattern selected has a dominant mix of small drops in a ratio of at least 5:3 for the entire page.

17. A printer for ejecting ink in a pattern of at least first and second different drop sizes in accordance with a page patterning methodology, comprising:

a printhead having an array of ink nozzles, each having a common nozzle geometry;

a driver capable of driving each individual nozzle with a selected one of at least two different full wavelength waveforms, each waveform causing ejection of a different drop size;

an image data input that receives image data from a source;

a processor that analyzes the received image data globally on a page by page basis to set the predetermined repeating alternating pattern of first and second drop sizes globally for each page that optimizes overall image quality for each particular page, the predetermined repeating alternating pattern set being selected from a pattern having a ratio of first to second drops in the pattern approximately 1:1 and one or more patterns having a ratio of first to second drops in the pattern substantially different from 1:1 so that one particular drop size is dominant in the pattern; and a waveform selector that selects one of the at least two different full wavelength waveforms for each nozzle of the nozzle array in accordance with the set page patterning methodology that is applied on a page basis to eject the set predetermined pattern of repeating alternating large and small drops on a page, wherein the nozzle array is driven based on the received image data to eject drops in accordance with the image data and the predetermined set repeating alternating pattern of rows and/or columns contains both first and second drop sizes.

18. The printer according to claim 17, wherein when the global analysis determines that the page is primarily solid fill, the pattern selected is set to have a dominant mix of large drops in a ratio of at least 5:3 for the entire page and when the overall image analysis determines that the page is primarily light fill, the pattern selected is set to have a dominant mix of small drops in a ratio of at least 5:3 for the entire page.

* * * * *